United States Patent [19]

Bercovici

[11] 4,106,956

[45] Aug. 15, 1978

[54] METHOD OF TREATING METAL ALLOYS TO WORK THEM IN THE STATE OF A LIQUID PHASE-SOLID PHASE MIXTURE WHICH RETAINS ITS SOLID FORM

[75] Inventor: Serge Bercovici, Grenoble, France

[73] Assignee: Societe de vente de l'Aluminium Pechiney, Paris, France

[21] Appl. No.: 770,017

[22] Filed: Feb. 18, 1977

Related U.S. Application Data

[63] Continuation-in-part of Ser. No. 564,475, Apr. 2, 1975, abandoned.

[30] Foreign Application Priority Data

Feb. 19, 1976 [FR] France ..... 76 05159

[51] Int. Cl.[2] ..... C22F 1/04

[52] U.S. Cl. ..... 148/11.5 A; 148/12.7 A

[58] Field of Search ..... 148/11.5 A, 12.7 A; 75/135

[56] References Cited

U.S. PATENT DOCUMENTS

| | | | |
|---|---|---|---|
| 2,249,353 | 7/1941 | Fritzlen | 148/12.7 A |
| 2,671,559 | 3/1954 | Rosenkranz | 148/12.7 A |
| 3,948,650 | 4/1976 | Flemings et al. | 75/135 |
| 3,988,180 | 10/1976 | Bouvaist | 148/12.7 A |

*Primary Examiner*—W. Stallard

*Attorney, Agent, or Firm*—Dennison, Dennison, Meserole & Pollack

[57] ABSTRACT

A process is disclosed for facilitating extrusion or rolling of a solidified dendritic aluminum base alloy billit, or the like, by heating the billet to provide an inner liquid phase of below 25%, by weight, wherein the dendritic phase has started to develop into a primary solid globular phase without disturbing the solidified character of the billet, followed by working of the treated billet. The process enables a reduction in working pressure and results in improved mechanical properties of the product. Optionally, in the case of precipitation hardening aluminum base alloys, quenching of the workpiece is effected as it exits from the die or mill, followed by artificial or natural aging. In another embodiment, the composition of the alloy of the billet being treated contains an amount of hardening constituent whereby the composition of the globular solid phase of the product approximates the composition of the alloy per se.

12 Claims, 3 Drawing Figures

METHOD OF TREATING METAL ALLOYS TO WORK THEM IN THE STATE OF A LIQUID PHASE-SOLID PHASE MIXTURE WHICH RETAINS ITS SOLID FORM

This is a continuation-in-Part of United States Application Ser. No. 564,475, filed Apr. 2, 1975, now abandoned.

This invention relates to a process wherein alloys of aluminum base can be worked in solidified form in a state constituted as a mixture of a solid phase and liquid phase. The invention also relates to the products produced by the process.

It is well known that, when a metal alloy in its solid state is progressively heated, the first traces of liquid phase appear the moment when the temperature of the solid equilibrium is reached and the proportion solid phase-liquid phase develops until the total liquefaction is reached which occurs the moment the temperature of the liquid equlibrium is passed over.

It has been discovered that without significantly disturbing the solid characteristics of a billet, or the like, that a solid aluminum base alloy can be subjected to a temperature between the temperature of the solid equilibrium and the temperature of the liquid equilibrium, wherein the ramified network of primary phase dendrites, which remain mostly solid during the process, has its structure dilapidated and progressively developed towards a globular form with dimensions depending on the fineness of the dendritic structure at the outset but they are generally between approximately 100 and 400 micrometers.

Furthermore, it has been determined that an alloy brought to and kept between the temperatures of the solid and the liquid equilibrium for a period of about 5 to 60 minutes retains the characteristics of a solid body and can be advantageously extruded or rolled as long as the proportion of the liquid phase does not exceed 25% by weight.

Also, it has been determined that the process lends itself particularly well to forming processes which are customarily utilized in connection with an aluminum base alloy maintained in its solid state, such as forming by wire-drawing, extrusion, rolling, die-forming, stamping, forging, etc. In this regard it should be kept in mind that at no time in carrying forth the process does the body of alloy being processed have the outward appearance or characteristics of a liquid.

The transformation of the solid phase of the dendritic structure towards a globular structure is accomplished with the alloy in a solid state but provides the alloy treated in accordance with the invention, plastic flow properties considerably improved over a body of solid alloy not treated in accordance with the present process. Thus the invention can advantageously be used to accelerate the flow velocities and to reduce the effort required by the forming machines. These new properties correspond to a special rheotropic state of the alloy.

It is important to emphasize that the rheotropic properties are not a simple consequence of the temperature increase. In effect, in view of the difficulties which the transformation processes of certain alloys in solid state represent, one might think that it would be sufficient to increase the drawing temperature, for instance, in order to reduce the effort required for drawing, for example. But, experience shows that a temperature of 450° C, generally used to draw alloys such as AU4SG, is the maximum that is never exceeded in industrial practice. Beyond this temperature, it has been determined that the plasticity of the metal, which is passed at a maximum temperature between 420° and 450° C, tends to diminish and, furthermore, the dynamic effort generated at the level of the draw-plate leads to an increase of the temperature so that the profile rod comes out in a partially liquified state and is thus unsuitable. In contrast, drawing of the "solid" body of alloy in the rheotropic state of the present invention generates relatively little dynamic effort at the level of the draw-plate and a very little cooling is sufficient to solidify, in the extruded profile rod the small amount of uniformly distributed liquid phase. The wear and tear of the tooling equipment is, furthermore, greatly reduced.

It will be appreciated from the foregoing that the process contemplates a low amount of liquid phase, namely below 25%, by weight, the amount of liquid phase of course being in excess of 0%, and generally in the order of 3% to 25%, by weight, as is more specifically disclosed in connection with the illustrative examples.

It is equally important that it be appreciated that the physical state of the aluminum base alloy being treated and worked is such that at no time during the process is the alloy capable of being agitated, stirred, or mixed inasmuch as the alloy at all times retains the outward appearance and characteristics of a solid. The alloy behaves like a solid and it is not changed into a slurry. Thus, it is impossible to put the alloy in an apparatus and agitate, stir or mix it because a liquid -solid mixture having no more than 25% liquid is too viscous to be stirred and cast.

A very significant aspect of the invention resides in the fact that it has been found that by holding a billet, slab, or the like, of an aluminum base alloy at a temperature between solidus and liquidus, the solid dendritic phase, though it does not melt, develops into a globular form and when the liquid phase does not exceed 25% by weight, the solid body of alloy may be worked at reduced pressure.

In the case of aluminum alloys with precipitation hardening, it has been discovered that the level of the mechanical properties of the profiles extruded, rolled, etc., can be improved by utilization of two additional optional steps combined with the above described basic treatment of the alloy.

The first of these optional steps comprises quenching the extruded products on the press, etc., as the profile exits from the die, etc., followed by artificial or natural aging.

The second optional step comprises adapting the composition of an aluminum base alloy in a specific manner, namely increasing the amount of hardening constituent with a view to giving products which have been treated in accordance with the basic process, quenched on the press, the artificially or naturally aged, the same properties as profiles made from a reference alloy not treated in accordance with the process which has been solution heat treated, quenched, and aged.

Quenching on the press, which comprises severely cooling the profiles at the outlet of the press either with pulsated air or by spraying water, mixtures of air and water or mist, is not traditionally practiced on precipitation hardening alloys since it is generally ineffectual. Since the alloys in question are capable of precipitation hardening, the quenching on the press must in fact keep the maximum of elements which are capable of precipitation when aged, in solid solution in order to improve the properties. Now conventional extrusion conditions, e.g. at 420° C, do not put enough elements back into solution for quenching on the press to produce any marked improvement. Thus the expert in extrusion of hard alloys such as 2024 (A-$U_4$G), 2014 (A-$U_4$SG) and 7075 (A-$Z_5$GU) knows very well that it is useless to quench these alloys at the outlet of the press and that, if the profiles are to have maximum properties, it is necessary to carry out a solution heat treatment, then to quench it with water and finally to age it.

The treatment according to the basic process herein also has another result, namely a reduction in the critical quenching rate of the alloy; relatively gentle quenching, e. g. with pulsated air, thus becomes effective. These more gentle quenching methods have another, considerable advantage, in that the profiles are not deformed.

It should be pointed out that it would certainly not be sufficient, in the case of A-$U_4$SG for example, simply to heat to 572° C in the hope of achieving a similar result by quenching on the press followed by aging.

This would give a profile without any cohesion, characteristic of a burnt metal. It is essential to first heat treat the alloy by the present process, namely holding at the temperature range given to provide no more than 25% liquid phase and to give the product its special globular structure together with the use of a cooled die.

A second improvement results from an intensive study of the metallurgical mechanisms involved in the treatment according to the invention. For this the reader should refer to FIG. 3. For the sake of simplicity this is a binary diagram, although the same reasoning can be applied to more complex alloys.

U.S. Pat. No. 3,948,650 to Flemings et al., and the thesis by one of the inventors, namely Spencer, referenced therein is directed to mixtures of lead-tin that behave like liquid wherein one starts with liquid metal and one freezes it partially while a "vigorous agitation" is produced by a mixer, so as to prevent the solid phase from forming a network of dendrites, or a continuous skeleton network which would be more or less rigid even in the presence of liquid. This is so because under the effect of the mixer, the solidifying metal develops globular nodules separated from each other, and while the mixture of solid-liquid obtained becomes more and more viscous with an increase in the amount of solid phase, it does not solidify, but more nearly has the characteristics of sand in water.

Liquid-solid mixtures as disclosed in Flemings and the Spencer thesis are suitable for isostatic deformation in which the alloy is acted upon from all directions, for instance in a closed die forging or hot pressing, such as disclosed in the Flemings patent. Such liquid-solid mixtures can hardly be rolled or extruded because they behave like a wet sponge wherein the contained liquid tends to exude if one applies forces in only one direction such as in rolling or extruding operations.

U.S. Pat. No. 2,770,022 to Brennan discloses the hot forming of a metal which is not in a fully solidified condition. This metal is obtained by a partial solidification from the liquid metal contained in the crucible and not from a body of solid metal which has been heated to a temperature between solidus and liquidus and held at this temperature while it keeps its solid shape. Thus, in the Brennan patent, the metal which is hot formed is, of course, a mixture of solid and liquid phase, since it is freezing. But, because this solidification takes place without stirring, the solidified metal has a dendritic structure and not the globular structure obtained by the practice of the present process. Further, the hot formed products thus produced is not the same as the product produced herein.

In order to illustrate the effect of the process which is the object of the invention, one can compare the micrographic structures of an aluminum alloy AU4GS containing approximately 4% copper, 1% silicon, 0.8% manganese, 0.5% magnesium.

Figure 1:
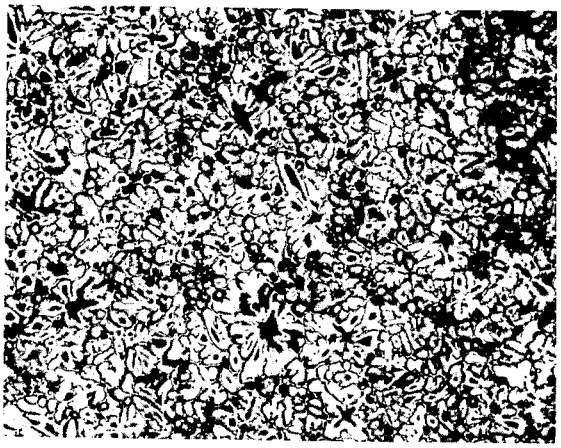
FIG. 1 is a micrograph enlarged 50 times and depicts the structure of an alloy of AU4GS which was obtained in the classic form of semicontinued processing of a billet with the dendritic structure clearly visible.
Figure 2:
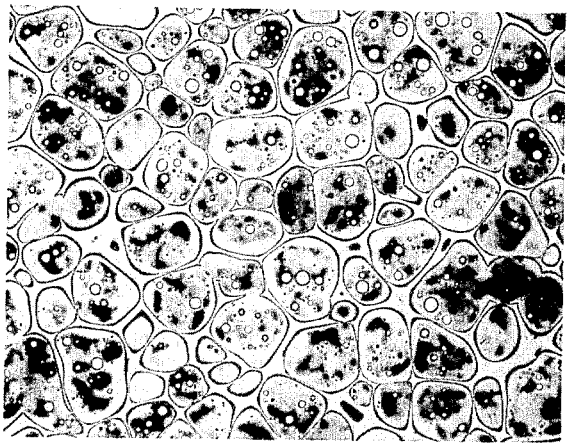
FIG. 2 is a micrograph enlarged 50 times of the same alloy as illustrated in FIG. 1 treated in accordance with the invention.

The micrographs constituting FIGS. 1 and 2, were taken after "SEGOL" attack which consists of an anodic attack in a mixture containing 1000 $cm^3$ phosphoric acid and 30 g chromic anhydride, at 90° C for 1 to 2 mn under a continuous voltage so that the current density on the sample amounts to approximately 2mA/$cm^2$. The black areas of FIG. 2 are the globules of the primary phase produced by the degeneration of the dendrites. Inside the globules, the presence of sperhic rosettes with white contours is noticed which are produced by liquid droplets which were imprisoned in the course of the thermal treatment.

The duration of maintaining the necessary temperature to produce the appearance of the globular structure and to confer the plastic flow properties to the solid state in accordance with the invention, varies according to the type of alloy and for a given alloy according to the temperature which is kept and which determines the relation of the liquid phase-solid phase. As an example, the duration may range from a few minutes to 4 hours and preferebly from about 5 to 60 minutes for the aluminum-zinc-magnesium alloys or aluminum-silicon-copper-magnesium alloys.

Cylindric billets obtained by casting in molds continuously or semicontinuously, treated according to the invention, can be fed, for example, into a drawing press. Once introduced into the press, they can be extruded in the form of profile rods. Appropriate means of cooling the draw-plate and the section leaving the draw-plate may be employed where desired and cooling by water or by air sufficiently to solidify almost the totality of the liquid fraction contained in the drawn billet.

The advantages of the process are the following: increased drawing ratio and/or drawing speed; reduced drawing pressure; thus reducing wear and tear of the tooling equipment.

The applicant has also determined that, when the cooling of the billet treated in accordance with the invention is effected to reach room temperature or any temperature below the solid equilibrium and it is then reheated to a temperature between the solid and the liquid corresponding to below 25%, by weight, the billet will regain its rheotropic properties almost instantaneously which is proof that there has been a permanent modification of its structure and establishment of a new phase relationship. This reheating can be effected at a room temperature higher, equal to or lower than the temperature of the first treatment depending upon the percentage of liquid phase up to 25% that is desired.

Only the aluminum part is shown. It is assumed that the intermetallic compound which causes structural hardening forms an eutectic with the aluminum. An alloy of composition A is taken to be heated gradually from the solid state. At temperature $T_1$ of point S' it begins to melt. If, in accordance with the main patent, the alloy is then brought to temperature T greater than $T_1$ and held there, the alloy will develop in the course of time to a condition where the liquid phase will reach homogeneous composition L and the solid phase (the globules) homogeneous composition S. A study of the diagram then shows that the composition of the globular solid phase is less charged with added elements than the average composition of the alloy.

It has been discovered that, if the amount of hardening constituent in the alloy is increased by giving it the composition corresponding to point A', so that the globular solid phase approaches composition S', of alloy A, if one then applies the treatment of holding at temperature $T_1$ above the solidus of alloy A', and finally if the alloy is extruded and quenched on the press, then the properties which can then be obtained simply by aging are similar or even superior to those of alloy A, which has been extruded in the conventional manner then given the complete conventional treatment of solution heat tranting, quenching and natural or artificial aging.

Naturally composition A', that is to say, the precise position of M' on horizontal temperature line $T_1$, is defined by the quantity of liquid phase required; this depends e. g. on the powerfulness of the press and the extrusion ratio.

$$\text{The } \frac{\text{liquid phase}}{\text{solid phase}} \text{ weight ratio is in fact equal to } \frac{M'S'}{M'L'}$$

The conventional treatment of the profiles, comprising:

(a) solution heat treating at a relatively high temperature (e. g. 495° C)
(b) quenching the profiles
(c) natural or artificial aging has thus been replaced by a much simpler treatment:

(a) quenching the profiles at the outlet of the press, which is easy to carry out,
(b) natural or artificial aging which gives similar properties without having the drawbacks of the first treatment.

These drawbacks are of two categories:

(a) the furnaces for solution heat treating of the alloy are voluminous as long profiles are involved,
(b) there is serious deformation during quenching, necessitating subsequent straightening of the profiles; whereas quenching on the press may, according to the invention be more gentle and does not therefore deform the profile.

It should be pointed out in this case that simply to combine an increased content of hardening constituents with quenching on the press would by no means give the same result since, as stated above, water quenching is ineffectual with alloys which have not been treated in accordance with the heat treating process.

As mentioned in the disclosure, it is not of course necesssary to proceed to extrusion immediately after holding to proceed to extrusion immediately after holding the alloy at the temperature between the solidus and liquidus. The billet can very well be left to cool after that treatment to a temperature below the solidus or even to ambient temperature. It is then sufficient to heat it before extrusion, rather than holding it at an intermediate temperature between the solidus and liquidus.

The following examples more specifically illustrate exemplary modes of the invention. All drawing tests of the examples 1 to 7 have been effected on a Loewy press of 800 tons.

EXAMPLE I

Three cylindric billets with a diameter of 100 mm and a length of 300 mm of alloy AU4SG (chemical composition: aluminum base, iron 0.42%, silicon 0.91%, copper 4.24%, manganese 0.82%, magnesium 0.51%) rough castings, have been kept for 15 minutes at the respective temperatures of 595° C to the respective proportions of the liquid phase of about 6% (billet A), about 8% (billet B), about 13% (billet C).

They have been introduced into the holder, preheated to 420°–450° C, of the drawing press of 800 tons and drawn immediately at a speed of 8m/minute in the form of rectangular profile rods of 40 × 3 mm. The water cooling of the draw-plate has been adjusted in such a way that the temperature of the profile rods when leaving the draw platforms was about 450° C. The handling of the billets has been effected under the normal conditions and the drawing in a satisfactory manner. From each billet about 15 meters of profile rod with a perfect aspect of the surface have been obtained. The mechanical characteristics have been measured by means of samples: rough drawing, tempered 8 hours at 175° C, hardened with water after 2 hours kept at 505° C then tempered 8 hours at 175° C (state T6), with the following results:

| | Billet A/585° C | | | Billet B/595° C | | | Billet C/605° C | | |
|---|---|---|---|---|---|---|---|---|---|
| State | LE hb | R hb | A % | LE hb | R hb | A % | LE hb | R hb | A % |
| Rough drawing | 22.5 | 35.4 | 22.2 | 24.1 | 38.1 | 24.2 | 24.8 | 34.9 | 23.5 |
| 8 Hours at 175° C | 31.1 | 37.1 | 12.7 | 35.4 | 40.2 | 12.7 | 33.3 | 37.7 | 12.9 |
| 2 Hours at 505° C hardened with water | 41.4 | 46.9 | 14.8 | 42.4 | 47.1 | 13.3 | 43.0 | 47.6 | 14.4 |
| 8 hours at 175° C (state T6) | | | | | | | | | |

These characteristics which are clearly independent of the treatment temperarture are entirely satisfactory and comparable to those which were obtained with products drawn in the classic manner.

EXAMPLE II

A billet of AU4SG with a diameter of 100 mm and of the same composition as in Example I has been treated in accordance with the invention for 15 minutes at 572° C so that about 4% of liquid phase would appear. It was drawn in order to obtain a round rod with a diameter of 20 mm (i. e., a drawing ratio of 25) at a speed of 3 meters/minute. The medium pressure of the press amounted to 150 bars.

The same test effected in accordance with the classic process of hot drawing with a billet not treated according to the invention has required a pressure of 220 bars, i.e., about 50% higher.

The following characteristics of the drawn rods were obtained:

| | Yield strength hbar | Ultimate tensile strength hbar | Elongation % |
|---|---|---|---|
| Conventional extrusion | | | |
| As extruded | 18.8 | 34.8 | 15.1 |
| Aged 8 hours at 175° C | 18.6 | 31.4 | 14.9 |
| T6 State (quenched and aged) | 51.3 | 55.6 | 12.2 |
| Extrusion according to invention | | | |
| As extruded 572° C | 22.1 | 37.3 | 14.3 |
| Aged 8 hours at 175° C | 23.8 | 34.2 | 12.9 |
| T6 State (quenched and aged) | 49.8 | 53.8 | 10.8 |

The following will be observed:

1. A reduction in extrusion pressure, enabling the productivity of existing extrusion presses to be increased and
2. an improvement in tensile strength and elongation for the states where the alloy is:
   — as extruded
   — aged 8 hours at 175° C

EXAMPLE III

Two billets of AZ5G (aluminum base, zinc 4.40% magnesium 1.18%) with a diameter of 100 mm have been drawn one in the classic way and the other after treatment in accordance with the invention (30 minutes at 620° C so as to form 4% liquid phase).

A round rod with a diameter of 20 mm was drawn at a speed of 13.2 meters/minute.

The necessary pressure amounted to 155 bars for the billet that was not treated and to 118 bars for the billet that was treated in accordance with the invention, i.e. a reduction of 24%.

EXAMPLE IV

Two billets of AZ5G (composition identical to that of Example III) have been drawn with a bridge draw-plate to obtain tubular rods with square sections of 25 × 25 mm and a thickness of 2 mm, one was not treated and the other was treated in accordance with the invention, for 20 minutes at 625° C so as to form 7% liquid phase.

The necessary pressure amounted to 280 bars for the billet which was not treated and to 238 bars for the billet treated according to the invention, i.e., a reduction of 17%.

EXAMPLE V

Two billets of AU4SG of the same composition and of the same dimension as in Example I have been drawn on a bridge draw-platform, one was not treated, the other one was treated in accordance with the invention, 30 minutes at 585° C so as to form 6% of liquid phase in order to obtain a tubular rod with square sections of 25 × 25 mm and a thickness of 2mm.

The drawing of AU4SG on a bridge draw-platform is generally not practiced. In this particular case, it has produced mediocre results with a bad aspect of the surface and has required a pressure of 290 bars which is near the limit authorized for a press of 800 tons.

In return, the drawing of the billet treated in accordance with the invention has given excellent results and has only required a pressure of 210 bars.

EXAMPLE VI

A billet of AU4SG of the same composition and the same dimensions as in Example I has been treated in accordance with the invention by keeping it 15 minutes at 620° C in order to obtain 25% liquid phase. Then it was introduced into the holder of the drawing press. In order to avoid any risk of deformation, the treating and the transporting of the billet from the heating oven to the press have been effected on a semicircular horizontal cradle.

A profile rod of 40 × 3 mm has been extruded without any difficulty and with a pressure which did not exceed 220 bars. The 800 ton press used for this test does not permit the drawing of AU4SG into 40 × 3 mm under classic conditions (billet of 100 mm preheated to 420°/450° C).

Thus, the use of the invention has, in this case, a spectacular advantage.

EXAMPLE VIII

A cylindric billet with a diameter of 100 mm and a length of 300 mm of alloy AU4SG was kept for 15 minutes at 585° C so as to form about 6% liquid phase, then cooled down to room temperature, then reheated to 595° C and without delay introduced into the holder, preheated to 420°–450° C of the 800 ton drawing press and immediately drawn at a speed of 8 meters/minute in the form of rectangular profile rods of 40 × 3 mm. The water cooling of the draw-plate had been adjusted in such a way that the temperature of the profile rod when leaving the draw-plate amounted to about 450° C.

The results of this test have been the same as in the Example I B which shows that a simple reheating to the chosen temperature restores instantaneously the rheotrope properties of a billet that was first treated in accordance with the invention and then cooled.

EXAMPLE VIII

By means of dying, a connecting rod for a compressor was manufactured of AU4SG (distance between the axis of the piston and the crankshaft, 100 mm). Generally, the realization of such a connecting rod requires a roughing operation and a finishing operation.

By reheating the piece for 15 minutes at 595° C so as to have appear 8% liquid phase, the mentioned connecting rod was obtained in one dying operation with a pressure of 40 bars in the hydraulic circuit of the press instead of 100 bars under customary conditions.

EXAMPLE VIX

A billet of A-$U_4$SG which is 100 mm in diameter and identical in composition to the alloy in Example I:

Fe = 0,42%

Si = 0,91%

Cu = 4,24%

Mn = 0,82%

Mg = 0,51% remainder = aluminium is brought to 605° C and kept at that temperature for 15 minutes.

At equilibrium, the liquid phase content at that temperature is approximately 13%.

A slug of this billet is placed in the container of a 800 T extrusion press, the container being pre-heated to 420°–450° C. It is extruded immediately in the form of a profile with a rectangular section of 40 mm × 3 mm. The water-cooling of the die is regulated to make the profile emerge at a temperature of approximately 450° C. As soon as it leaves the press the profile is quenched with cold air, using a battery of fans with their air flow directed towards the profile. The mechanical properties are then measured on samples which are either as extruded, or aged for 8 hours at 175° C., or homogenised for 2 hours at 505° C, quenched with water and aged for 8 hours at 175° C. ($T_6$ state).

The table below sets out the results obtained, compared with a billet which is not air quenched but which has undergone the treatment according to the main patent.

| STATE | NON QUENCHED BILLET YS (hbar) | UTS (hbar) | E % | QUENCHED BILLET YS(hbar) | UTS (hbar) | E % |
|---|---|---|---|---|---|---|
| as extruded | 24,8 | 34,9 | 23,5 | 21,6 | 38,7 | 24,8 |
| aged at 8 hours at 175° | 33,3 | 37,7 | 12,9 | 37 | 42,8 | 12,4 |
| 2 hours at 505° Water quenched 8 hours at 175° $T_6$ State | 43,0 | 47,6 | 14,4 | 44,7 | 49,4 | 11,6 |

UTS = ultimate tensile strength
YS = yield strength (in hbars)
E = elongation at break (in %)

It will be noted that there is a marked improvement in properties in the quenched billet after a single ageing process at 175° C.

EXAMPLE X

Taking the average composition of a different alloy, A-$U_4$G in which the average copper and magnesium content is respectively 4,25% and 0,65%, this is used to determine what average composition an alloy must have so that, when brought to a temperature at which it would contain approximately 3% of liquid phase, its solid phase would have an average composition equal to that of A-$U_4$G:4,25% of copper and 0.65% of magnesium.

This can be ascertained by using equilibrium diagrams, but since ternary diagrams are less well known than binary ones it is advisable to supplement the information provided by these diagrams with partial welding experiments covering a range of different contents, with microprobe analysis of the solid phase.

An alloy with a copper content of 5,10% and an Mg content of 0,80% is found to have about 3% of liquid phase at 555° C, the solid phase having the approximate composition of the normal A-$U_4$G alloy.

A billet 100 mm in diameter is cast with the corresponding required content and also containing the secondary constituents added to the alloy.

The final composition obtained is:

Fe = 0,42%

Si = 0.38%

Cu = 5,20%

Mg = 0.90%

Mn = 0,60%

Ti = 0,025%

Zr = 0,14%

It will be noted that the contents obtained are slightly larger than those which it was hoped to obtain.

The billet is then cut into four slugs 300 mm long and each is subjected to different treatment.

Slug N° 1, in the form of an angle 25 mm × 25 mm × 3 mm, is extruded normally at 420° C., i.e. in known manner. The profile is cooled in still air at the outlet of the press, followed by ageing treatment (maturation)

Slug N° 2 is extruded in accordance with the main patent, i.e. at a temperature of 555° C., after having been held at that temperature for 30 minutes. The profile is cooled in still air at the outlet of the press and subjected to ageing treatment.

Slug N° 3 is treated in accordance with the present invention, that is to say, held at 555° C for 30 minutes then extruded at that temperature. The profile obtained is quenched in pulsated air with a quenching rate in the order of 600° C to 800° C per minute, and finally undergoes 16 days' ageing treatment.

Slug N° 4 is treated and extruded under the same conditions as number 3, except that quenching is carried out with jets of water, again followed by 16 days ageing.

The mechanical properties of the profiles obtained are then measured. These are set out in the table which folows, as are the average properties found in profiles of A-$U_4$G of normal composition which have undergone the usual treatment of solution heat treating, quenching and ageing.

| Chip No. | EXTRUSION CONDITIONS Temperature of slug in ° C | Speed m/mn | QUENCHING TREATMENT ON PRESS Temperature at outlet in ° C | Quenching rate °/mn | HEAT TREATMENT AFTER QUENCHING | MECHANICAL PROPERTIES YS kg/mm2 | UTS kg/mm2 | E % |
|---|---|---|---|---|---|---|---|---|
| 1 | 420° | 4.5 | | Still Air | Ageing 16 days | 28.6 | 39.9 | 11.6 |
| 2 | 554° | 4 | 450° | Still Air | Ageing 16 days | 26.1 | 40.5 | 24.4 |
| | | | Quenching With Pulsated Air | | | | | |
| 3 | 557° | 4.5 | 440° | 600 to | Ageing 16 days | 31.9 | 45.8 | 18.2 |

-continued

| | EXTRUSION CONDITIONS | | QUENCHING TREATMENT ON PRESS | HEAT TREATMENT AFTER QUENCHING | MECHANICAL PROPERTIES | | |
|---|---|---|---|---|---|---|---|
| | | | 800°/mn from 440 to 240° C | | | | |
| 4 | 560° | 4.5 | Quenching With Water | Ageing 16 days | 30.8 | 43.7 | 25.7 |
| Average for normal A-UG | 420° | | Still Air | solution heat treating + water quenching and ageing | 32 | 43 | 18 |

The table clearly shows the importance of the combination: change in composition — heat treatment above the solidus — quenching on the press (in air or water). This gives properties which are as good, if not better than those obtained with an A-$U_4$G of normal composition which is extruded normally then solution heat treated, quenched and aged. The solution heat treatment is thus dispensed with.

I claim:

1. A process for the treatment of a mass of solid aluminum alloy for making extruded products of aluminum alloy comprising the steps of:

(a) heat treating a billet of said alloy having a primary dendritic phase by subjecting it without agitation to an intermediate temperature between solidus and liquidus corresponding to a ponderable proportion of the liquid phase below about 25%;

(b) maintaining said billet at said intermediate temperature without agitation for a sufficient period of time to permit the solid dendritic phase to at least begin direct transformation into the globular form;

(c) subjecting said treated billet of aluminum alloy without agitation to extrusion while at said intermediate temperature state.

2. A process for the treatment of a mass of solid aluminum alloy for making extruded products of aluminum alloy in accordance with claim 1 wherein the billet thus heat treated is cooled to any temperature below the solidus temperature, reheated to an intermediate temperature between the solidus and liquidus temperatures corresponding to a ponderable properties of the liquid phase below about 25%, then extruded.

3. A process in accordance with claim 1 including quenching the extrusion at the outlet of the extrusion die and hardening the quenched extrusion by natural or artificial aging.

4. A process in accordance with claim 2 including quenching the extrusion at the outlet of the extrusion die and hardening the quenched extrusion by natural or artificial aging.

Figure 3:
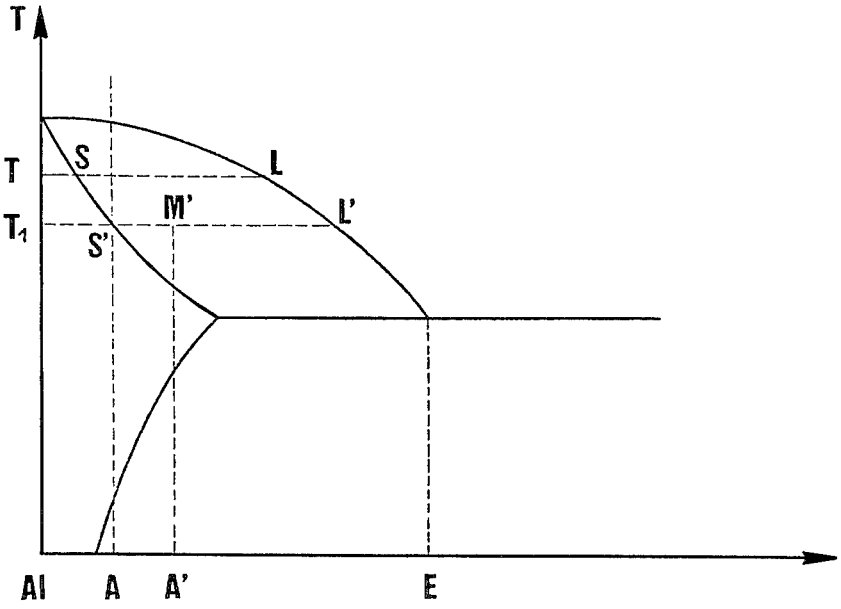
FIG. 3 is a binary diagram illustrating the parameters for selecting the amount of hardening constituent in accordance with an embodiment of the invention.

5. A process in accordance with claim 1 including treating an alloy composition selected in accordance with a binary diagram as in FIG. 3 wherein the composition of the globular form has the same average content of hardening elements as the alloy per se.

6. The product produced by the process of claim 1.

7. A process for the treatment of a mass of solid aluminum alloy for making rolled products of aluminum alloy comprising the steps of:

(a) heat treating a slab of said alloy having a primary dendritic phase by subjecting it without agitation to an intermediate temperature between solidus and liquidus corresponding to a ponderable proportion of the liquid phase below about 25%;

(b) maintaining said slab at said intermediate temperature without agitation for a sufficient period of time to permit the solid dendritic phase to at last begin direct transformation into the globular form;

(c) subjecting said treated slab of aluminum alloy without agitation to rolling while at said intermediate temperature state.

8. A process for the treatment of a mass of solid aluminum alloy for making rolled products of aluminum alloy in accordance with claim 7 wherein the slab thus heat treated is cooled to any temperature below the solidus temperature, reheated to an intermediate temperature between the solidus and liquidus temperatures corresponding to a ponderable properties of the liquid phase below about 25%, then rolled.

9. A process in accordance with claim 7 including quenching the extrusion at the outlet of the extrusion die and hardening the quenched extrusion by natural or artificial aging.

10. A process in accordance with claim 8 including quenching the extrusion at the outlet of the extrusion die and hardening the quenched extrusion by natural or artificial aging.

11. A process in accordance with claim 7 including treating an alloy composition selected in accordance with a binary diagram as in FIG. 1 wherein the composition of the globular form has the same average content of hardening elements as the alloy per se.

12. The product produced by the process of claim 7.

* * * * *